United States Patent [19]

Kratz et al.

[11] Patent Number: 4,531,463

[45] Date of Patent: Jul. 30, 1985

[54] BAFFLE FOR CONTROLLED AIR INCINERATORS

[75] Inventors: Richard L. Kratz, Hereford; Darrel R. Kiser, Perkasie; R. Scott Smith, Lansdale, all of Pa.

[73] Assignee: American Energy Corporation, Lansdale, Pa.

[21] Appl. No.: 544,977

[22] Filed: Oct. 24, 1983

[51] Int. Cl.[3] ..... F23B 5/00; F23C 9/00

[52] U.S. Cl. ..... 110/212; 110/214; 110/219; 110/234; 110/244; 110/296; 110/300; 110/310

[58] Field of Search ..... 110/210, 211, 212, 213, 110/214, 219, 235, 234, 243, 244, 248, 295, 296, 269, 300, 309, 310, 311

[56] References Cited

U.S. PATENT DOCUMENTS

| | | | |
|---|---|---|---|
| 3,408,167 | 10/1968 | Burden, Jr. | 110/213 |
| 3,489,109 | 1/1970 | Flowers, Jr. | 110/213 |
| 3,543,700 | 12/1970 | Baigas, Jr. | 110/213 |
| 3,785,305 | 1/1974 | Schrage | 110/212 |
| 3,844,233 | 10/1974 | Fishback | 110/212 |
| 3,880,594 | 4/1975 | Shaw | 110/212 |
| 4,145,979 | 3/1979 | Lilley et al. | 110/210 |
| 4,356,778 | 11/1982 | McRee, Jr. | 110/212 |
| 4,424,755 | 1/1984 | Caffyn et al. | 110/210 |
| 4,432,287 | 2/1984 | Brillantes | 110/210 |

OTHER PUBLICATIONS

"Waste Makes Energy", John W. Maxson, Jr., *Delaware Valley Business Magazine*, pp. 38–39.

*Primary Examiner*—Henry C. Yuen
*Assistant Examiner*—Steven E. Warner
*Attorney, Agent, or Firm*—Woodcock, Washburn, Kurtz, Mackiewicz & Norris

[57] ABSTRACT

A controlled air incinerator includes a primary and secondary combustion chamber. Combustion by-products from the primary chamber are exhausted to the secondary chamber. In the secondary chamber a source of auxilliary heat is provided to maintain the temperature in that chamber at a point which is sufficiently high to fully combust any particulate and unwanted gaseous matter. The secondary combustion vessel is provided with a baffle means for increasing the residence time of combustion by-products in the secondary chamber. The baffle means comprises an arch preferably oriented concave downwardly, the inlet to the secondary chamber being situated beneath the arch. The baffle means means increases residence time and increases the turbulence of gases passing through the secondary chamber.

16 Claims, 7 Drawing Figures

BAFFLE FOR CONTROLLED AIR INCINERATORS

FIELD OF THE INVENTION

The present invention relates, in general, to a controlled air incinerator, and, in particular, it relates to a controlled air incinerator having a baffle provided for conservation of auxiliary fuel and for increasing efficiency in the removal of particulates.

Most waste disposal and especially solid waste disposal in the United States is by way of sanitary landfills. Because of the scarcity of suitable locations for sanitary landfills, and further because of the environmental concerns which landfills create, this method of waste disposal is not particularly preferred. In addition, hauling costs contribute greatly to the overall cost of waste disposal using sanitary landfills. Incineration of solid and liquid waste is preferable to landfill disposal for many reasons. On-site incineration of waste eliminates hauling costs and precludes ground and water pollution. Incineration of waste materials also provides the opportunity to harness the energy of the resulting heat. Incineration techniques are known which harness the resulting or recovered energy from the combustion of waste materials with the recovered energy being used to generate steam, hot water, hot air, to generate electricity or to provide steam-driven absorption cooling. With the significantly higher energy costs of the last decade, the savings realized from the utilization of energy from the combustion of waste have been significant. Incineration of waste, however, creates other and different environmental concerns to those created by sanitary landfills. Specifically, incineration of waste may create air pollution by the release of unwanted particulate and gaseous material into the atmosphere.

One technique of minimizing or eliminating the release of such particulate or gaseous matter into the atmosphere has been through the use of controlled air incinerators. A controlled air incinerator is an incinerator in which the combustion of waste is monitored and in which the combustion air is controlled so as to approach as nearly as possible the complete combustion of the waste materials. One such controlled air incinerator has been provided by the assignee of the present invention. The controlled air incinerator of the present assignee has been one in which a primary combustion chamber is provided. Waste is automatically loaded and burned in the primary combustion chamber. A secondary combustion chamber vertically adjacent the primary combustion chamber is also provided. Combustion by-products from the primary chamber are exhausted to the secondary combustion chamber. In the secondary combustion chamber a source of auxiliary heat is provided to maintain the temperature in that chamber at a point which is sufficiently high to fully combust any particulate and unwanted gaseous matter in the combustion gases such that substantially all unwanted particulate and gaseous matter exiting the secondary combustion chamber has been removed. Because of the high cost of energy, it would be desirable to reduce and minimize the auxiliary heat added to the secondary combustion chamber, while at the same time, maintaining complete combustion therein.

To reduce the auxiliary heat requirement in the secondary combustion chamber while maintaining complete combustion the residence time of the gases passing through that chamber must be increased. One obvious method of increasing residence time in the secondary chamber is to increase the size of the chamber. However, the size of the secondary chamber is limited by physical constraints as well as by cost considerations. Another method of increasing residence time of the gases in the secondary chamber might be to employ a baffle for slowing the velocity of the gas passing through the chamber. Baffles, however, in general, tend to create back pressures which affect the combustion in the primary chamber.

In addition to increasing the residence time of gases in the secondary chamber, complete combustion in that chamber can be facilitated by increasing the turbulence of the gases passing through the chamber. By increasing the turbulence of the gases, and at the same time increasing the residence time of the gases, additional savings of auxiliary fuel may be expected.

It would be desirable to provide a controlled air incinerator having reduced auxiliary fuel consumption.

It would also be desirable to provide a controlled air incinerator which enjoys reduced auxiliary fuel consumption and yet which fully combusts the waste materials which it processes.

It would also be desirable to accomplish the foregoing objectives without unduly increasing the size of the secondary combustion chamber relative to the primary combustion chamber.

SUMMARY OF THE INVENTION

These and other objects of the present invention are achieved by provision of a controlled air incinerator having a primary and secondary combustion vessel interconnected by means of a flame or inlet port. Heating means are provided in both combustion vessels. The secondary combustion vessel is provided with a baffle means for increasing the residence time of combustion by-products in the secondary chamber, whereby auxiliary fuel for the heating means located there is conserved. In accordance with an important aspect of the present invention, the baffle means comprises a refractory arch, the loci of the apices of which is generally parallel to and located at the longitudinal axis of the cylindrical secondary vessel. The arch is preferably oriented concave downwardly and the inlet or flame port to the secondary chamber is situated beneath the arch, as is the auxiliary heating means for the secondary chamber. The baffle means is effective in increasing residence time and increasing the turbulence of gases passing through the secondary chamber.

In accordance with another important aspect of the present invention, a source of combustion air is provided for the secondary combustion vessel. This combustion air is directed to the vessel by means of nozzles directed to the flame port region, the center lines of the nozzles being offset with respect to each other such that the center lines do not intersect. Moreover, the nozzles are directed at an angle to horizontal. Such an orientation tends to create spiral turbulence in the secondary combustion chamber.

DETAILED DESCRIPTION OF THE PREFERRED EMBODIMENT

Figure 1:
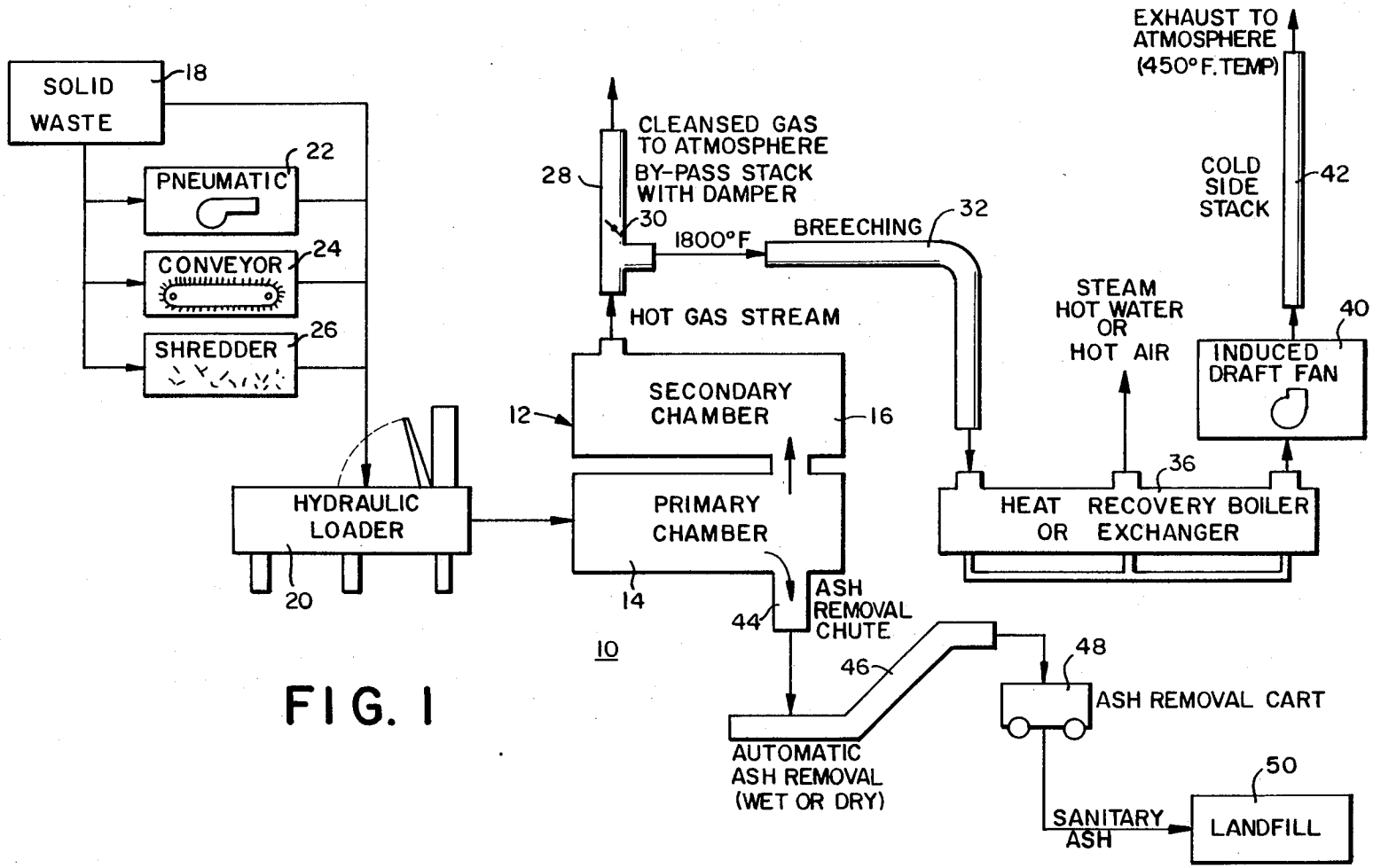
FIG. 1 is a schematic diagram of a controlled air incinerator system of the present invention.

Referring now to FIG. 1 a controlled air incinerator system is shown generally at 10. The controlled air incinerator system 10 includes an incinerator shown generally at 12 having a primary combustion chamber 14 connected to a secondary combustion chamber 16. Solid waste 18 is directed to the incinerator 12 by means of a hydraulic loader 20. The solid waste is conveyed to the hydraulic loader 20 directly or, alternatively, may be conveyed by means of a pneumatic loader 22, a conveyor 24, a shredder 26, or any combination of the three. Combustion by-product gases from the secondary combustion chamber 16 are directed to the atmosphere by means of a bypass stack 28 as shown. Situated within the bypass stack 28 is a bypass damper 30. With the bypass damper 30 in an open position, hot gases are vented to the atmosphere. With the bypass damper 30 closed however, as shown, combustion by-product gases are directed through a breeching 32 to a heat recovery boiler or a heat exchanger 36. The heat recovery boiler or heat exchanger 36 may be used to generate steam, hot water or hot air. The steam may be used to further generate electricity, or to provide steam-driven absorption cooling, or the like. Combustion by-products are driven through the heat recovery boiler or heat exchanger 36 by means of an induced draft fan 40 which, in turn, directs the gases to the cold side stack 42 for exhaust to the atmosphere. Gases leaving the cold side stack are typically at a temperature of about 450° F.

In a preferred embodiment of the present invention, the controlled air incinerator system 10 of FIG. 1 further includes a means for removing ash generated in the primary combustion chamber 14. This means includes an ash removal chute 44 directed to a conveyor 46. Ash, whether wet or dry, is deposited by the conveyor 46 to an ash removal cart 48 for conveyance to a landfill 50.

Figure 2:
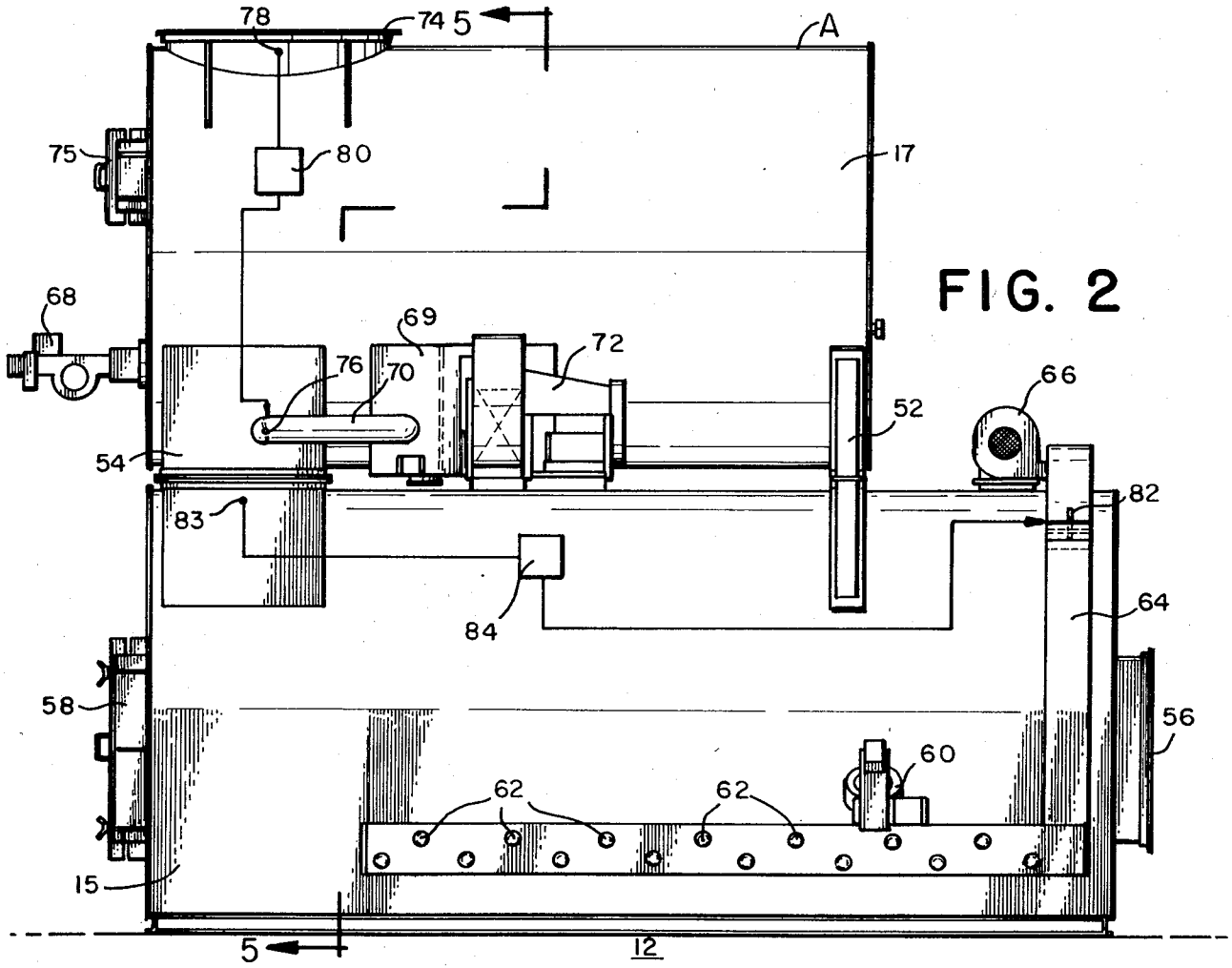
FIG. 2 is a side elevational view of a controlled air incinerator utilized in the system of FIG. 1.

Referring now to FIG. 2, the incinerator 12 shown in the system 10 of FIG. 1 will be described in further detail. As shown in FIG. 2, the incinerator 12 includes a primary combustion vessel 15 and a secondary combustion vessel 17, the interiors of which comprise the primary and secondary combustion chambers 14 and 16, respectively which have been referred to above. In the preferred embodiment of the present invention, and as shown in FIG. 2, the secondary combustion vessel 17 is situated vertically above the primary combustion vessel 15 and is supported thereat by means of a mounting support 52. The primary combustion vessel 15 and the secondary combustion vessel 17 are interconnected by means of a flame port 54.

Waste material to be incinerated is inserted into the primary combustion vessel 15 by the hydraulic loader 20 at the loading area 56. At the opposite end of the primary combustion vessel 15, a large object loading door 58 may also be provided. Energy for combustion in the primary combustion chamber 14 is provided by means of a first heating means or primary burner 60 which may be either oil or gas fired, as desired. Combustion air in the primary combustion chamber 14 is provided by means of underfire air ports 62. The underfire air ports 62 are connected by means of a manifold 64 to an underfire air blower or fan 66. The underfire air blower or fan 66 forces air through the manifold 64 to the underfire air ports 62 for introduction into the primary combustion chamber 14. While one primary burner 60 is shown, it should be understood that other primary burners may also be provided.

The secondary combustion vessel 17 includes a second heating means or auxiliary burner 68 which, like the primary burner 60 mentioned above, may be either oil or gas fired. The secondary burner 68 extends through a wall of the secondary combustion vessel 17 in the vicinity of the flame port 54. Combustion air in the secondary combustion chamber 14 is provided by means of a combustion air plenum 69 having first and second air canals 70 and 71 (FIG. 3) which are directed to the secondary combustion chamber 16 in the region of the inlet or flame port 54. Combustion air is directed through the first and second combustion air canals 70 and 71 by means of a combustion air blower or fan 72 which induces the flow of air from the external environment through the secondary air canals 70 and 71. Fully combusted gases emanating from the secondary combustion chamber 16 are directed to the bypass stack 28 or to the breeching 32 mentioned above through the outlet port 74. At a first end of the secondary combustion vessel 17 an inspection door 75 may be found which provides access to the secondary combustion chamber 16 when necessary.

Situated within each of the combustion air canals 70 and 71 is a damper 76 controlled by a modulating motor (not shown) preferably of the type made by Honeywell and denominated Model No. 744. Situated near the outlet port 74 is a thermocouple 78 which detects the output temperature of combustion by-product gases passing through the outlet port 74. The output of the thermocouple 78 is directed to an electrical controller 80 which, in turn, controls the modulating motor referred to above and, thus the position of the dampers 76.

Also situated in the combustion air manifold 64 are additional dampers 82, which are controlled by additional modulating motors (not shown) of the type referred to above. A thermocouple 83 in the vicinity of the flame port 54 detects the temperature of gases leaving the primary combustion chamber 14. The output of the thermocouple 83 is directed to a second electrical controller 84 which controls the modulating motors for the dampers 82.

Figure 3:
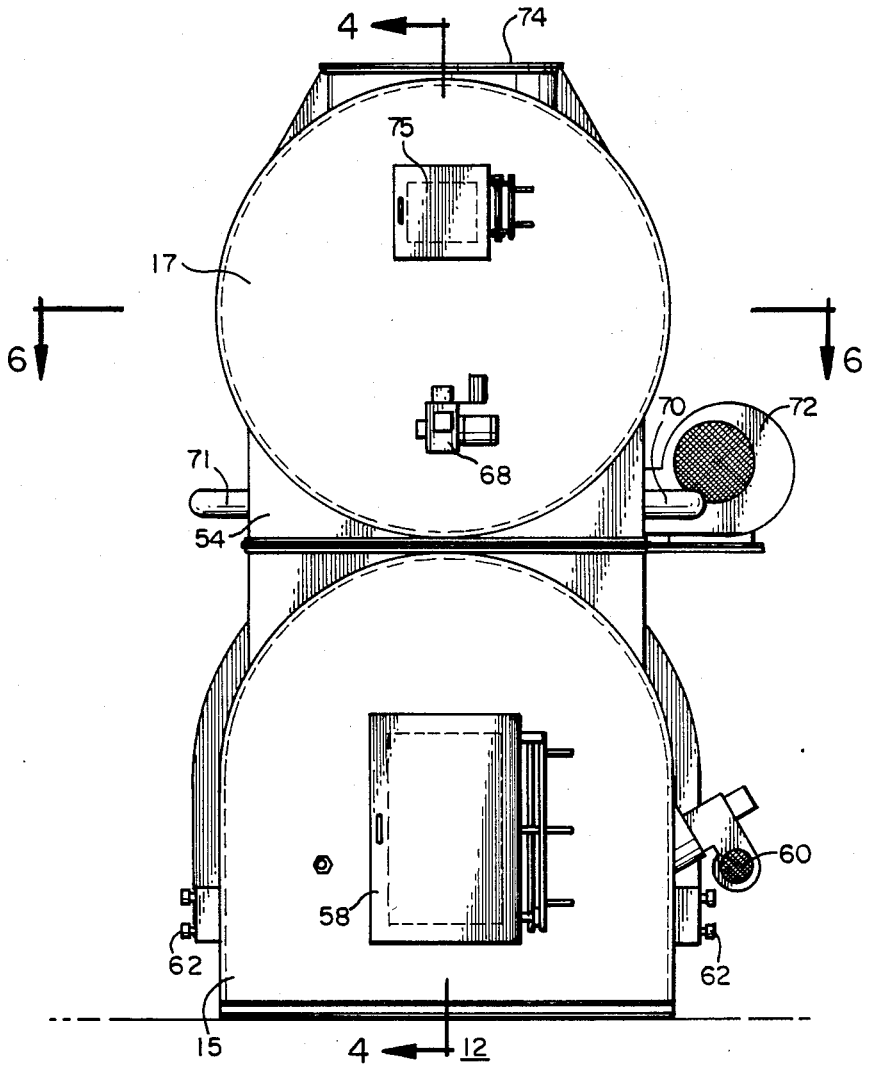
FIG. 3 is an end view of the incinerator of FIG. 2.
Figure 4:
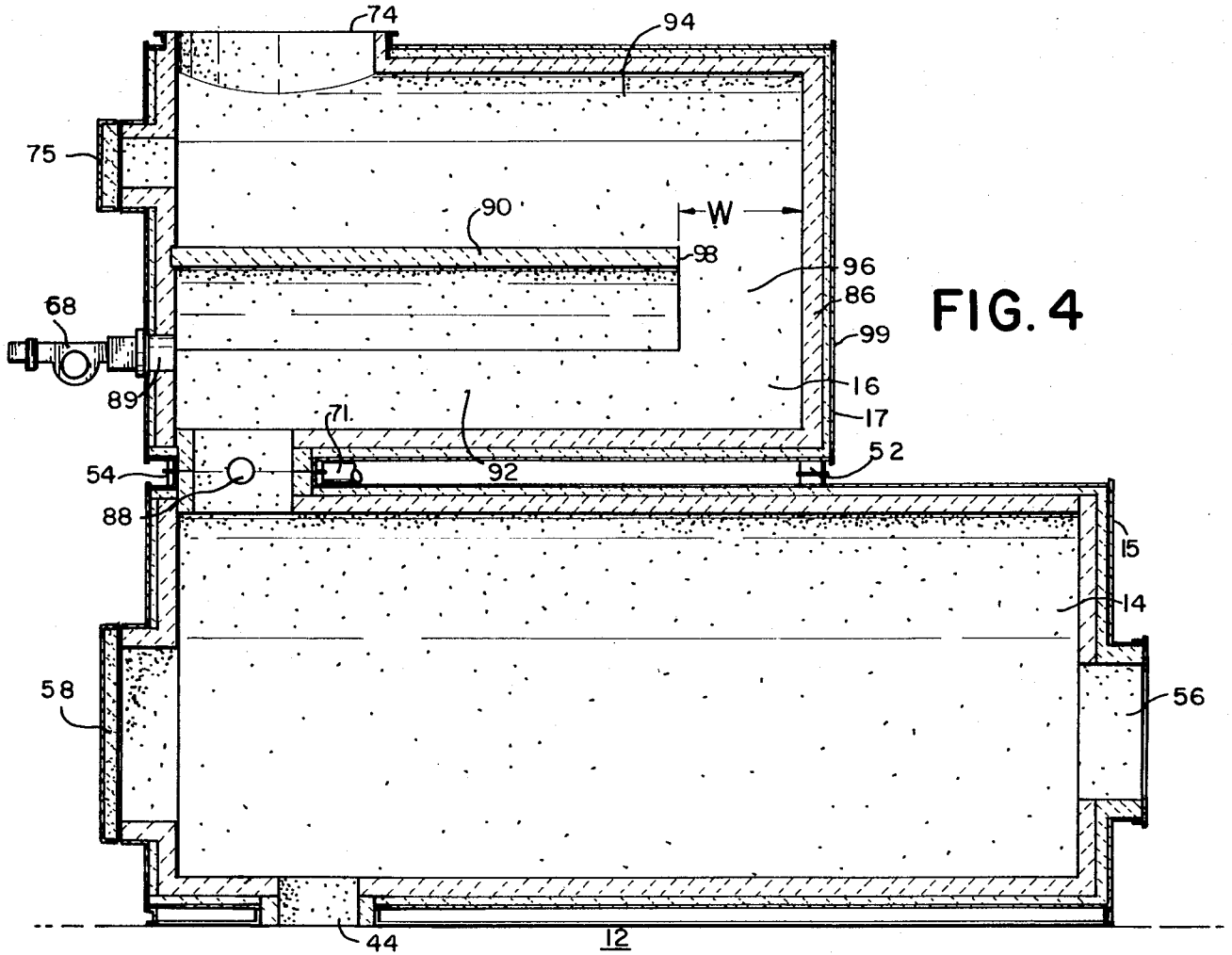
FIG. 4 is a cross-sectional view of the incinerator of FIG. 3 taken along section lines 4—4 thereof.

As may best be seen from FIG. 3, the secondary combustion vessel 17 is preferably cylindrical and is situated vertically above the primary combustion vessel 15. In accordance with an important aspect of the present invention, and as shown in FIG. 4, both the flame port 54 and the outlet port 74 to the bypass stack 28 are formed in a peripheral wall of the secondary vessel 17. The inlet or flame port 54 and the outlet port 74 are diametrically opposed to one another and both are situated adjacent the same end of the secondary combustion vessel 17. Because of the provision of a baffle means to be discussed below, such a positioning of the flame port 54 and outlet port 74 tends to increase the residence time of gases flowing through the secondary combustion chamber 16, which facilitates complete combustion of those gases. This baffle and its construction will be more fully appreciated by reference to FIG. 4. In the absence of such a baffle, the residence time of gases in the secondary chamber 16 would be maximized if the outlet port 74 were located at the opposite end of the secondary vessel 17 from the flame port 54 such as, for example, at the position shown at point A in FIG. 2.

Referring to FIG. 4, it will be seen that both the primary combustion vessel 15 and the secondary combustion vessel 17 are lined with firebrick or other refractory material 86. Such firebrick or refractory material is necessitated by virtue of the fact that the preferable operating temperatures of the primary combustion chamber are in the range of 1700° to 1800° F., whereas temperatures in the secondary combustion chamber 16 typically range between 1800° and 2300° F. Also, as may be seen from FIG. 4, the flame port 54 is also lined with refractory material. The combustion air canals 70 and 71 terminate in the inlet or flame port 54 at the position shown at 88 so as to provide air in the vicinity of the auxiliary burner 68 which protrudes through the wall of the secondary combustion vessel 17 just above the flame port 54 at the aperture 89.

Figure 5:
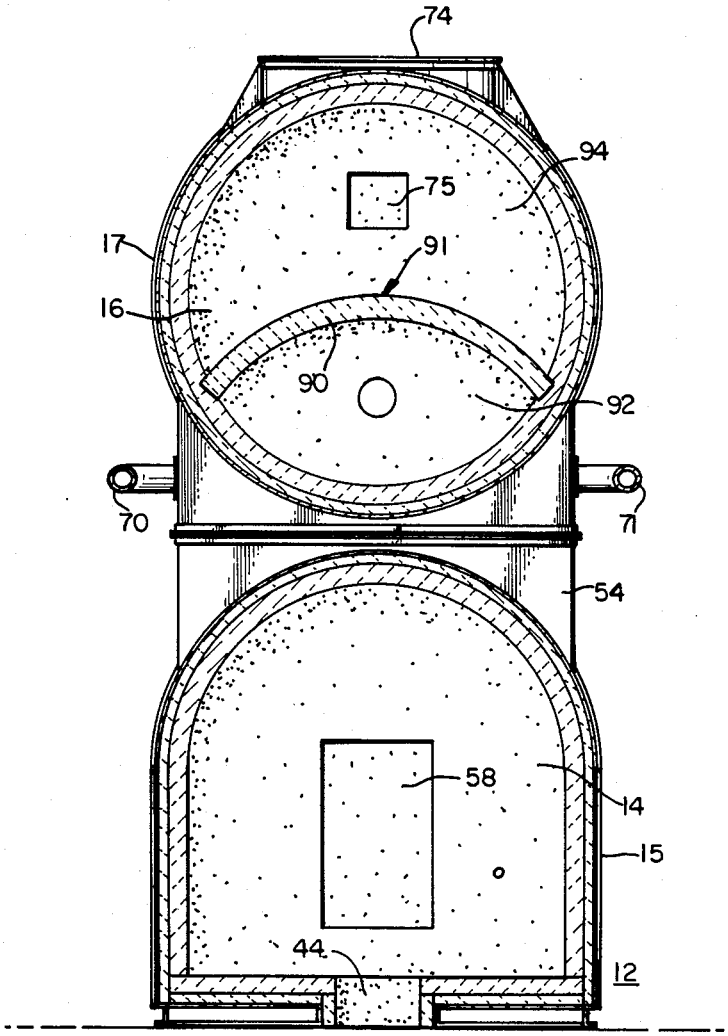
FIG. 5 is a cross-sectional view of the incinerator shown in FIG. 2 along section lines 5—5.

In accordance with the most important aspect of the present invention, and as may best be seen from FIGS. 4 and 5, the secondary combustion chamber 16 includes a baffle 90 which extends from one end wall of the secondary combustion vessel 17 substantially the entire length of the secondary combustion vessel 17. The baffle 90 has the effect of increasing the residence time of gas passing through the secondary chamber 16 from the inlet port 54 to the outlet port 74. The baffle 90 permits full combustion of by-products from the primary chamber 16 so as to minimize air pollution at the outlet port 74. This is accomplished, moreover, with significant fuel savings in the operation of the auxiliary burner 68.

The baffle 90 is formed of firebrick or other refractory material and is preferably formed in the shape of an arch, the loci of the apices 91 of which are preferably situated at and parallel to the longitudinal axis of the secondary combustion vessel 17. The arched baffle 90 is situated so as to be concave downwardly so as to divide the secondary combustion chamber 16 into two primary zones connected by a third zone. The first of these zones 92 lies beneath the arched baffle 90 while the second of the zones 94 lies above the arched baffle 90. The inlet or flame port 54 opens to the first zone 92 while the outlet port 74 opens from the second zone 94. In accordance with an important aspect of the present invention, the cross-sectional area of the first zone 92 in the direction transverse to the longitudinal axis of the vessel 17 is less than the cross-sectional area of the second zone 94.

In the particularly preferred embodiment, the cross-sectional area of the first zone 92 is approximately equal to the cross-sectional area of the flame port 54. Moreover, the cross-sectional area of the first zone 92 is about one half that of the second zone 94. In other words, the cross-sectional area of the first zone 92 is approximately one-third of the total cross-sectional area of the secondary vessel 17 in the direction transverse to the longitudinal axis thereof.

As the cross-sectional area of the first zone 92 is decreased, the velocity of gases traveling through it increases which in turn decreases residency time. On the other hand as the cross-sectional area increases, heat conduction from the baffle 90 to the traveling gases is lessened, which tends to increase auxiliary fuel usage. It is for these reasons that the relationship of the cross-sectional areas referred to above is preferred.

The first and second zones 92 and 94 of the vessel 17 are interconnected by means of the third or connecting zone 96. The third or connecting zone 96 is situated between one end 98 (FIG. 4) of the baffle 90 and a remote end 99 of the secondary combustion vessel 17. The width W of this connecting zone 96 is sufficiently large to preclude a venturi effect of gases passing between the first zone 92 and the second zone 94. To prevent such a venturi effect, the width W of the connecting zone 96, as well as the cross-sectional area of the first zone and the second zone 94 are selected so as to prevent the formation of back pressure which may affect combustion in the primary combustion chamber 15. In fact, the width W of the connecting zone 96 is preferably selected such that this width multiplied by the inside diameter of the vessel 17 is approximately equal to 1.5 times the cross-sectional area of the flame port 54.

The arched baffle 90 disclosed and shown in FIGS. 4 and 5 is particularly advantageous in reducing auxiliary fuel costs. It is postulated that the curved surface of the arched baffle 90 is particularly effective for heating gases passing through the first zone 92 of the secondary combustion chamber 16 by means of convection, conduction and radiation. It is further postulated that the arched baffle 90 causes the gases passing through the secondary chamber 16 to be subjected to spiral turbulence in passing through the first zone 92 which aids in fully combusting those gases. It is still further postulated that the existence of the arched baffle 90 increases the residence time of gases in the secondary chamber 16 by causing those gases to traverse the entire length of the secondary chamber 16 in the first zone 92 thereof, and thereafter to traverse the entire length of the chamber 17 a second time through the second zone 94 thereof. It has been calculated for various incinerator systems made by the assignee hereof that residence time of gases in the secondary chamber 16 may be increased from 12 to 16 percent when the baffle 90 is present as compared to similar systems without the baffle 90 and with the outlet port 74 relocated to position A as shown in FIG. 2. For whatever reason, auxiliary fuel utilized with controlled air incinerators of the type employing the baffle 90 of the present invention is significantly reduced.

Figure 6:
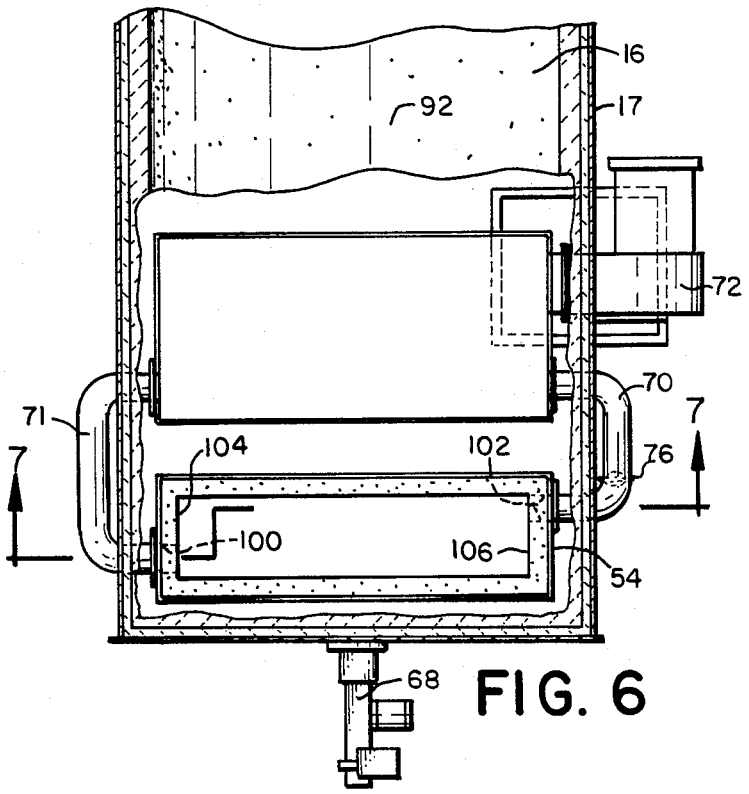
FIG. 6 is a partial cross-sectional view of the incinerator of FIG. 3 taken along section lines 6—6.
Figure 7:
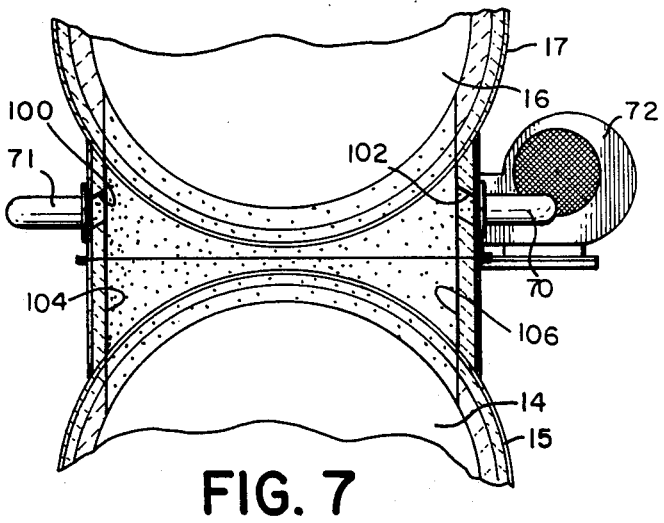
FIG. 7 is a partial cross-sectional view of the incinerator of FIG. 6 taken along section lines 7—7.

In addition to the increase in residence time, as referred to above, complete combustion of by-products in the secondary chamber 16 is facilitated by increasing the turbulence of gases flowing through that chamber. The baffle 90 tends to increase that turbulence. In accordance with another important aspect of the present invention, a means is provided for further increasing the turbulence of such gases. Attention is directed to FIGS. 6 and 7 in which this means for increasing turbulence is described. As shown in FIG. 6, combustion air for the secondary chamber 16 is provided by means of the combustion air blower or fan 72 which directs air to the combustion air plenum 69 which is situated vertically above the primary combustion vessel 15 and vertically below the secondary combustion vessel 17. Combustion air from the combustion air plenum 69 is directed through combustion air canals 70 and 71 to the vicinity of the flame port 54 as described above. As shown in FIG. 6, combustion air from the combustion air canals 70 and 71 is directed through the walls of the flame port 54 via first and second nozzles 100 and 102, respectively. While these nozzles permit the injection of air into the flame port 54 from opposing wall surfaces 104 and 106 thereof, the center line of those nozzles does not intersect. It is believed that by offsetting the center lines of the nozzles 100 and 102 with respect to each other, increased turbulence of combustion by-products in the secondary chamber 17 may be promoted. Moreover, as shown in FIG. 7, the center lines of each of the nozzles 100 and 102 is preferably inclined to horizontal at an angle of, for example, 15°. It is believed that by so inclining the nozzles 100 and 102, still further spiral turbulence of combustion by-products entering the secondary chamber 17 is promoted.

While the present exemplary embodiments of this invention have been illustrated and described in detail, it will be recognized that this invention may be otherwise variously embodied and practiced within the scope of the following claims.

What is claimed is:

1. A controlled air incinerator comprising:

a primary combustion vessel for receiving combustible materials;

a first means for heating said combustible materials;

a secondary combustion vessel for receiving combustion by-products from said primary vessel, said secondary combustion vessel being cylindrical and having a peripherally opening inlet port and a diametrically opposed peripherally opening outlet port at a first first end thereof;

a second means for heating said by-products as said by-products traverse said secondary vessel from said inlet port to said outlet ports; and a baffle means situated in said secondary vessel adjacent said first end thereof between said inlet port and said outlet port, said baffle means comprising an arch extending parallel to and substantially along the length of the longitudinal axis of said secondary combustion vessel, the apices of said arch being substantially parallel to said longitudinal axis, for increasing the residence time of said by-products in said secondary vessel.

2. The incinerator of claim 1 wherein said apices are parallel to and located along said longitudinal axis.

3. The incinerator of claim 2 wherein said secondary combustion vessel is vertically disposed with respect to said primary combustion vessel and wherein said arch is disposed concave downwardly.

4. The incinerator of claim 3 wherein said arch divides said secondary combustion vessel into a first zone and a second zone, said first zone communicating with said inlet port and said second zone communicating with said outlet port, said first and said second zones being connected by a third zone, the cross-sectional area of said second zone being greater than the cross-sectional area of said first zone.

5. The incinerator of claim 4 wherein said second zone has a cross-sectional area approximately two times the cross-sectional area of said first zone.

6. The incinerator of claim 4 wherein said second heating means is situated in said first zone.

7. A controlled air incinerator comprising:

a primary combustion vessel for receiving waste material;

a first means for heating said waste material in said vessel;

a secondary combustion vessel having an inlet port for receiving combustion by-products from said first vessel, and an outlet port for venting gases therefrom, said inlet port and said outlet port opening through a peripheral wall of said secondary vessel adjacent a first end wall thereof;

a second means for heating said combustion by-products in said secondary vessel; and an arch situated between said inlet port and said outlet port, said arch extending from said first end wall in a direction generally parallel to the longitudinal axis of said secondary vessel along a substantial portion of the length thereof for increasing the residence time of said by-products in said secondary combustion vessel whereby auxiliary fuel for said second means for heating is conserved.

8. The incinerator of claim 7 wherein:

the apices of said arch are parallel to and lie along said longitudinal axis.

9. The incinerator of claim 8 wherein:

said arch is oriented concave downwardly.

10. The incinerator of claim 9 wherein:

said second heating means is situated at said first end wall under said arch.

11. The incinerator of claim 10 wherein:

said inlet port is situated under said arch.

12. The incinerator of claim 7 wherein:

said arch divides said secondary combustion chamber into a first zone and a second zone connected by a third zone, said inlet port opening to said first zone and said outlet port opening from said second zone, the cross-sectional area of said second zone being greater than the cross-sectional area of said first zone.

13. The incinerator of claim 12 wherein:

said second zone has a cross-sectional area approximately two times the cross-sectional area of said first zone.

14. The incinerator of claim 13 wherein:

said first zone has a cross-sectional area approximately equal to the cross-sectional area of said inlet port.

15. The incinerator of claim 7 further comprising:

a plurality of combustion air nozzles for directing combustion air to said inlet port, said nozzles being oriented such that their center lines do not intersect.

16. The incinerator of claim 15 wherein said secondary combustion vessel is vertically disposed with respect to said primary combustion vessel and wherein said inlet port is vertically disposed.

* * * * *